US005957242A

United States Patent [19]

Suter et al.

[11] Patent Number: 5,957,242

[45] Date of Patent: Sep. 28, 1999

[54] MACHINE FRAME

[75] Inventors: Christian Suter, Unterehrendingen; Jules Christen, Ebikon, both of Switzerland

[73] Assignee: Inventio AG, Hergiswil, Switzerland

[21] Appl. No.: 08/713,529

[22] Filed: Sep. 13, 1996

[30] Foreign Application Priority Data

Sep. 15, 1995 [CH] Switzerland ..... 02606/95

[51] Int. Cl.[6] ..... B66B 11/08

[52] U.S. Cl. ..... 187/266; 187/264; 187/254; 187/251; 254/335

[58] Field of Search ..... 187/266, 264, 187/254, 251, 261, 262, 263; 254/264, 325, 326, 329, 332, 335, 334, 266, 336, 413, 415

[56] References Cited

U.S. PATENT DOCUMENTS 611,311 9/1898 Behr et al. ..... 254/336

FOREIGN PATENT DOCUMENTS 1033383 7/1958 Germany .
1506478 10/1969 Germany .
53-26049 3/1978 Japan ..... 187/266
54-115849 9/1979 Japan ..... 187/266

OTHER PUBLICATIONS

International Search Report.

*Primary Examiner*—David A. Bucci
*Assistant Examiner*—Thuy V. Tran
*Attorney, Agent, or Firm*—Greenblum & Bernstein P.L.C.

[57] ABSTRACT

A machine frame with two side members at its ends comprises support arms, which are pivotably mounted in semicircular cut-out bearing supports. The bearing supports may be arranged on differently high pedestals, which may result in different inclined positions for the machine frame with respect to a machine room floor. The inclined position may provide for a variable looping angle β at the drive pulley and variable cable spacing between the cage cables and the counterweight cables. Furthermore, the deflecting roller may be mounted in laterally displaceable bearing plates. The deflecting roller may be inserted above or below a pair of side members. The position of the deflecting roller with respect to the side members may also have an effect on the looping angle β and the cable spacing. The combination of these adjustment possibilities enables the substantially universally adaptability of the machine frame to different elevator systems and applications.

17 Claims, 2 Drawing Sheets

MACHINE FRAME

CROSS-REFERENCE OF RELATED APPLICATIONS

The present invention claims priority under 35 U.S.C. § 119 of Swiss Patent Application No. 02 606/95-0, filed on Sep. 15, 1995, the disclosure of which is incorporated by reference herein in its entirety.

BACKGROUND OF THE INVENTION

1. Field of the Invention

A machine frame for an elevator drive including a drive pulley and a deflecting roller. The deflecting roller may be variably positionable relative to the drive pulley. The position of the deflecting roller, relative to a drive pulley, may determine a spacing of carrying cables between the cage and the counterweight cables. Moreover, the deflecting roller position, with respect to the drive pulley, may influence a looping angle β of the carrying cables on the drive pulley. The spacing between the carrying cables may be determined by a horizontal distance between the axes of the drive pulley and the deflecting roller plus their respective radii. The looping angle β may be varied, within certain limits, by variably raising or lowering the arrangement of the deflecting roller relative to the drive pulley.

The above-noted features may be adapted to the individual requirements of construction and arrangement of the drive pulley and the deflecting roller in a machine frame which may depend on, e.g., cage size and nominal load. Thus, a number of arrangement variations may be contemplated depending on specific elevator models in use. Thus, by a single, substantially universally adaptable construction, the present invention may be utilized in a greater range of elevator systems than those in the prior art.

2. Discussion of Background Information

German published specification No. 1 033 383 discloses a simple drive unit for small-load elevators. This unit includes a drive pulley axle carrying a drive pulley and a belt pulley and arranged somewhat eccentrically at a horizontal profile beam. The belt pulley is arranged in driving connection with a motor including a small belt wheel and fastened while suspended below the profile beam. In addition, a pivotable rocker is arranged on the drive pulley axle and at its other end is provided a deflecting roller. The spacing between the carrying cables leading off can be varied within certain limits by the pivotable rocker which is retained in a desired position by a screwed-on vertical stay. Accordingly, the looping angle β changes constrainedly and uninfluenceably. This may potentially negatively influence driving capability. Further, since the above-noted simple drive unit does not meet the applicable safety regulations, the unit is generally not suitable for passenger elevators without significant construction and accessory device modifications.

SUMMARY OF THE INVENTION

It is therefore the object of the present invention to create an elevator drive machine frame for an elevator for transporting people and/or goods which can be easily adapted in situ to certain requirements specifically setting looping angle β and spacing between the carrying cables. Such a machine frame may be adjustably mounted such that the drive pulley and the deflecting roller are coplanar with respect to each other and offset (inclined) with respect to the machine room floor. Further, the deflecting roller may be displaceable relative to the machine frame.

The present invention presents a machine frame that can be arranged in different inclined positions and/or a deflecting roller that can be arranged in different positions.

The different inclined settings of the machine frame, which provides a corresponding change in the looping angle β, may be effected by utilizing pedestals at one or both ends. The pedestals may be variable in height and include semicircular cut-out portions in the bearing supports for pivotally mounting round ends of the machine frame.

The deflecting roller may be carried by a bearing plate which is laterally displaceable along the machine frame and which can be fixed in any desired position within a adjusting slot. Further, the deflecting roller may be arranged above or below the machine frame.

The present invention may be directed to a machine frame for an elevator drive. The machine frame may include a drive pulley, a deflecting roller, a bearing plate for rotatably mounting the deflecting roller, and a first and second support for supporting the machine frame. The bearing plate may adjustably vary a distance between the drive pulley and the deflecting roller.

According to a further feature of the present invention, the bearing plate may adjustably vary a distance between a cage cable and a counterweight cable.

According to another feature of the present invention, the frame may also include a lateral side member. The bearing plate may be movably affixed to the lateral side member.

According to a further feature of the present invention, the bearing plate may movably position the deflecting roller in a direction parallel to a longitudinal direction of the lateral side member.

According to yet another feature of the present invention, the bearing plate may position the deflecting roller at one of above the lateral side member and below the lateral side member.

According to still another feature of the present invention, the frame may also include a pedestal for one of adjustably raising and lowering at least one of the first and second supports.

According to another feature of the present invention, the pedestal may adjustably vary a looping angle.

According to yet another feature of the present invention, the lateral side member may be positioned parallel to a frame floor.

According to another feature of the present invention, the lateral side member may be positioned at an angle with respect to a frame floor.

A laterally arranged attachment drive may be mounted in operative connection with the drive pulley shaft. Additional accessories may be mounted at the machine frame, as will be described in greater detail below.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
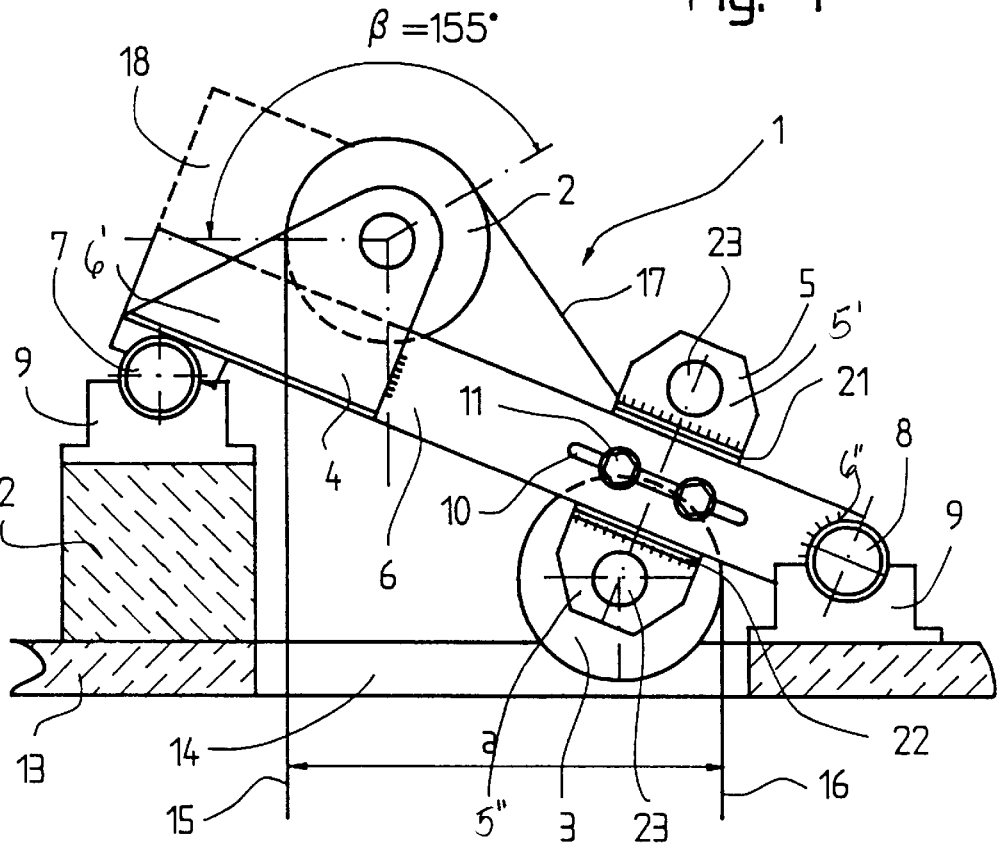
FIG. 1 shows a side elevation of the machine frame in inclined setting.
Figure 2:
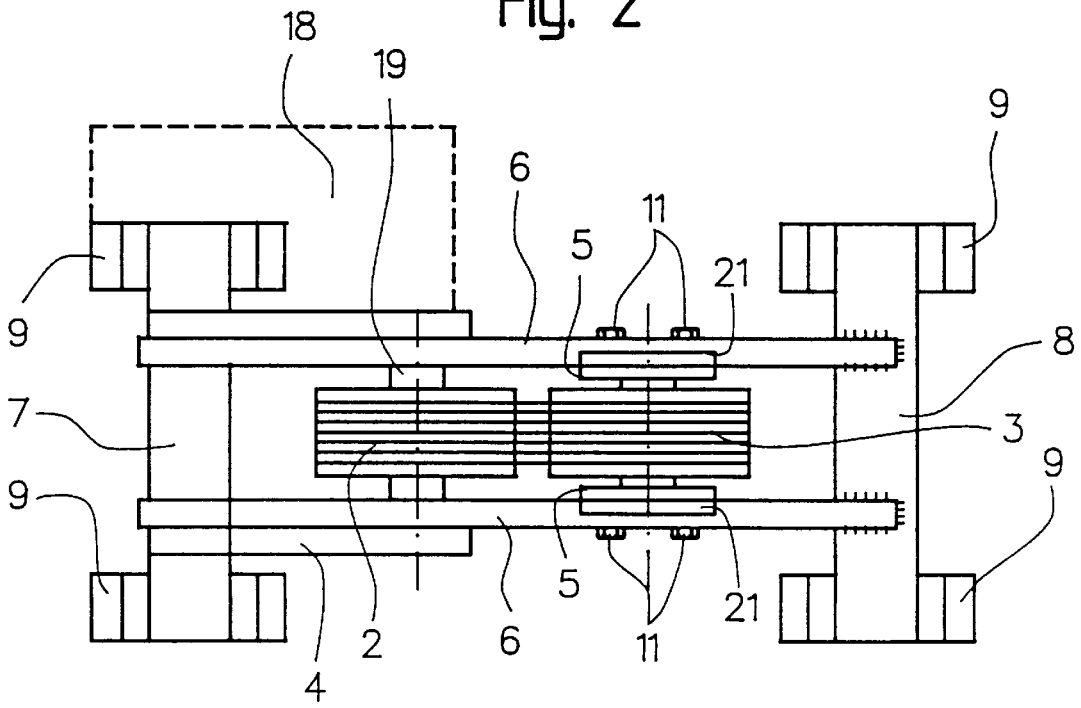
FIG. 2 shows a plan view of the machine frame.

As shown in FIGS. 1 and 2, a machine frame 1 is generally shown. Machine frame 1 may include a pair of lateral side members 6. A first end 6' of each lateral side member 6 may be coupled to a cylindrical support 7. Cylindrical support 7 may extend beyond an exposed lateral face of each lateral side member 6, as shown in FIG. 2. A second end 6" of each lateral side member 6 may be coupled to a support arm 8. As with cylindrical support 7, support arm 8 may extend beyond the exposed lateral face of each lateral side member 6. As shown in FIG. 1, cylindrical support 7 may be substantially tangentially coupled to a bottom of first end 6'. Second end 6" may include a semicircular cut out portion for coupling the second end 6" with substantially one-half of the outer circumference of support arm 8. Triangular bearing plates 4 may be arranged externally at first end 6' of lateral side members 6. Triangular bearing plates 4 may be arranged to be parallel with and adjacent to the exposed lateral face of each lateral side member 6. Further, each triangular bearing plate projects upwardly from its respective lateral side member 6 and may carry a portion of drive pulley axle 19 which supports a drive pulley 2.

A bearing plate 5 which may be laterally displaceable along lateral side members 6 may be arranged on second end 6" of machine frame 1. Bearing plate 5 may include an upwardly and downwardly extending portion 5' and 5", respectively. Each extending portion 5' and 5" may include a bore 23 for receiving an axle of a deflection roller 3. As shown in FIG. 1, the axle of deflection roller 3 is coupled to bore 23 in downwardly extending portion 5", however, the ordinarily skilled artisan will recognize that other advantages may be realized by coupling the axle of deflection roller 3 to bore 23 of upwardly extending portion 5', as discussed below. Within each side member 6 is a longitudinally extending adjusting slot 10. Screws 11 may be utilized to fix the position of bearing plate 5. Further, screws 11 may be loosened to enable adjustment of the position of bearing plate 5 along a longitudinal axis of lateral side member 6 within the range defined by adjusting slot 10. Bearing plate 5 may also include abutment strips 21 and 22 which abut a top and bottom edge of lateral side member 6 in order to prevent bearing plates 5 from dropping out of machine frame 1 when screws 11 are loosened. Thus, abutment strips 21, 22 form guides for slideably adjusting the position of bearing plates 5 longitudinally along the length of lateral side member 6.

Recessed bearing supports 9 may be positioned near the first and second end 6' and 6" of lateral side member 6 to support machine frame 1. Each recessed bearing support 9 may include a semicircular cut-out for receiving a respective end of one of cylindrical support 7 and support arm 8. The recessed bearing support positioned below cylindrical support 7 may be positioned upon a pedestal 12 and the recessed bearing support positioned below support arm 8 may be positioned on machine floor 13. Thus, a predetermined difference is maintained between the distance from cylindrical support 7 to machine room floor 13 and the distance from support arm 8 to machine room floor 13. In the situation illustrated in FIG. 1, the predetermined difference is equal to the height of pedestal 12.

Elevator cables 17 may be characterized as cage cables 15 and counterweight cables 16. Drive pulley 2 may be looped around, e.g., one or twice, etc., by elevator cables 17, an end running vertically downward from drive pulley 2 to an elevator cage (not shown) being known as the cage cable 15. The elevator cables 17 may also run obliquely downward from drive pulley 2 to be guided over deflecting roller 3. Deflection roller 3 may be looped around, e.g., one or twice, etc., by elevator cables 17 prior to running vertically downward from deflection roller 3 to an elevator counterweight (not shown) are known as the counterweight cables 16. As shown in FIG. 1, a looping angle β may be formed on drive pulley 2 at approximately 155°.

Cage cables 15 and counterweight cables 16 may be directed into an elevator shaft through an opening 14 in machine room floor 13. A spacing between cage cables 15 and counterweight cables 16 may be denoted by distance a. An attachment drive 18 may be coupled to the machine frame, as shown. Attachment drive 18 may include mechanical elements of a usual elevator drive, such as a motor, tacho-dynamo, brake, reduction gear, fixed coupling with the drive pulley 2 and torque stay (not shown).

FIG. 2 shows the machine frame of the present invention in plan view. Attachment drive 18 may be arranged at an upper side thereof. However, depending upon requirement, and prevailing space conditions, attachment drive 18 may also be provided at the other side. Bearing supports 9 may each be arranged below respective ends of cylindrical support 7 and support arm 8 to ensure a widest possible support of the machine frame 1. The bearing point below attachment drive 18 may be drawn up somewhat further for the purpose of optimum support and stability, which is indicated by dashed lines.

Figure 3:
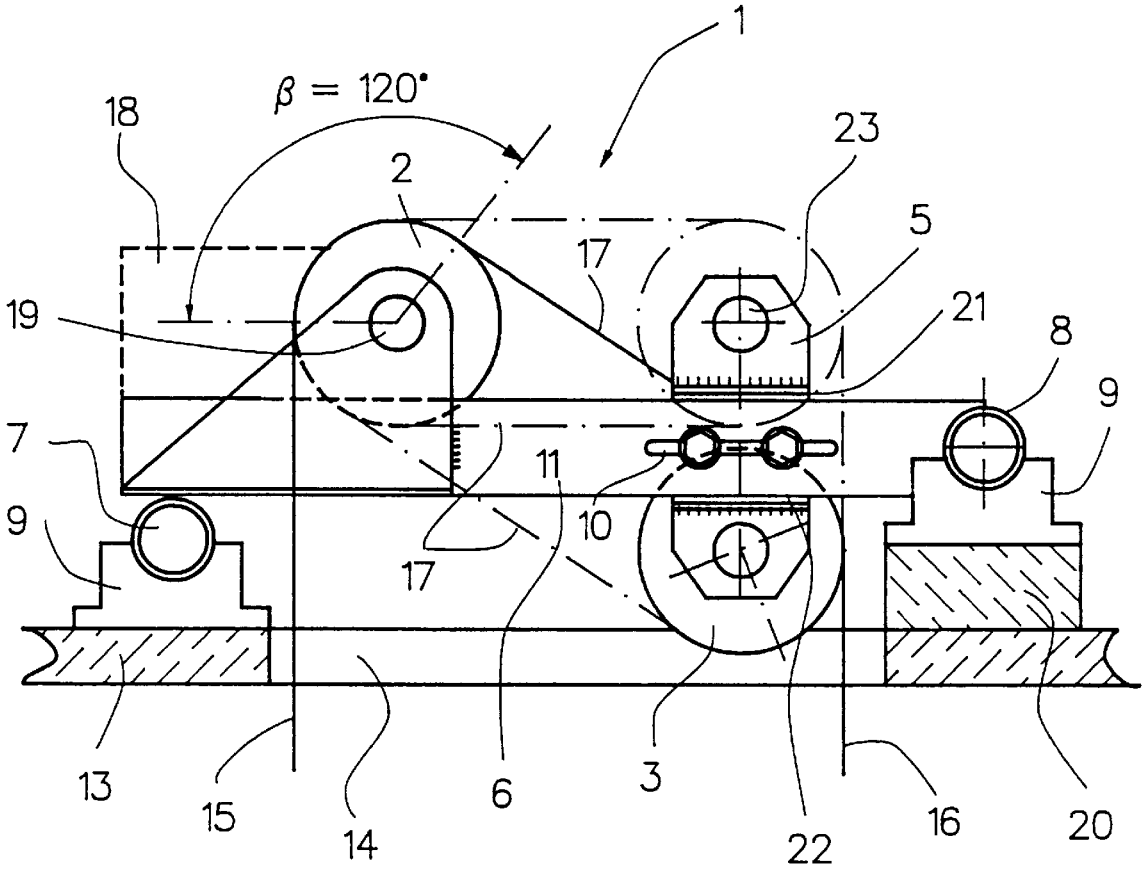
FIG. 3 shows a side elevation of the machine frame in horizontal setting.

FIG. 3 shows machine frame 1 according to an alternative arrangement in a horizontal position with respect to machine room floor 13. That is, lateral side members 6 are positioned substantially parallel to machine room floor 13. This change in position of machine frame 1 may be effected through different heights of pedestals 12 (FIG. 1) and 20 and utilizing the semicircular cut-outs of recessed bearing supports 9 as a slide bearing for support arms 7 and 8. Further, the semicircular cut-outs in recessed bearing supports 9 may enable a pivotable bearing of first and second ends 6' and 6" of the machine frame. In the situation illustrated in FIG. 3, a single looping angle β of 120° may be formed at drive pulley 2 by raising second end 6" with respect to first end 6'. By way of comparison with the inclined position depicted in FIG. 1, horizontal positioning of the machine frame 1 may result in a reduction in the looping angle β by approximately 35°. Alternatively, the looping angle β could be increased by approximately 35° by positioning machine frame 1 in an inclined position, as shown in FIG. 1.

However, not only may looping angle β be varied by adjusting the relative inclination of the machine frame 1 with respect to machine room floor 13, but also distance a between cage cables 15 and counterweight cables 16 may be varied. In addition to adjusting the relative inclination of machine frame 1, the distance a and the looping angle β may be adjustably varied by adjusting the position of bearing plate 5 along the length of lateral side number 6 and within adjusting slot 10.

Another alternative manner for varying distance a and/or looping angle β makes use of the upper portion 5' of bearing plate 5. As shown generally in FIGS. 1 and 3, the axle of deflecting roller 3 is mounted in bore 23 of lower portion 5". However, bearing plate 5 may be symmetrically shaped. Thus, the axle of deflecting roller 3 may alternatively be mounted in bore 23 of upper portion 5', as shown in phantom lines in FIG. 3.

Therefore, the two characteristic magnitudes of looping angle β and cable spacing distance a may be varied within certain defined limits by each of the three above-mentioned alternative manners of adjustment. Accordingly, a single machine frame structure may be utilized in a wide field of applications, which results in correspondingly greater production runs and reduced unit costs.

The construction of machine frame 1, according to the present invention, is not intended to be limited or restricted to the construction details shown above. Thus, for example, upper portion 5' with bore 23 may be omitted in the displaceable bearing plate 5. However, bearing plate 5, with only one lobe, offers the same positioning variability as the double lobe bearing plate, except that to change the lower portion to an upper portion the single lobe must be physically removed (or loosened) and reattached to (or rotated with respect to) the lateral side wall 6.

Further, pedestals 12 and/or 20 may include fixed height stackable pedestal plates. The pedestal plates may be immovable relative to each other through shape-locking and may be assembled in a modular manner in accordance with the specific height requirements necessary.

According to the present invention, different accessory apparatuses, e.g., a speed limiter, may be coupled to machine frame 1, e.g., with mechanical connecting parts and assembly holes positioned at suitable places on lateral side members 6.

The specific construction of machine frame 1 may also accommodate an electromechanical or hydraulic cable brake as a second brake. The electromechanical or hydraulic cable brake may be arranged to bridge across the two lateral side members 6.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

LIST OF DESIGNATED ELEMENTS

1 Machine frame
2 Drive pulley
3 Deflector roller
4 Bearing plate
5 Displaceable bearing plate
5' Upper portion
5" Lower portion
6 Lateral side member
6' First end
6" Second end
7 Cylindrical support
8 support arm
9 Recessed bearing support
10 Adjusting slot
11 Screws
12 Pedestal
13 Machine room floor
14 Opening
15 Cage cables
16 Counterweight cables
17 Elevator cables
18 Attachment drive
19 Drive pulley shaft
20 Pedestal
21 Upper abutment strip
22 Lower abutment strip
23 Bearing bore

What is claimed:

1. An apparatus for an elevator drive comprising:

a machine frame including:

a drive pulley;

a deflecting roller; and adapting equipment for the deflecting roller, said adapting equipment being variably positionable relative to said drive pulley;

said machine frame being adjustably mountable to a machine room floor for varying a looping angle and a cable spacing distance; and said deflecting roller being displaceable within said machine frame.

2. The apparatus according to claim 1, said machine frame further comprising cylindrical support arms positioned at opposite ends of said machine frame for supporting said machine frame.

3. The apparatus according to claim 2, further comprising a pair of bearing supports and at least one pedestal, and said cylindrical support arms pivotably mounted in a recess formed in said bearing supports.

4. The apparatus according to claim 1, said deflecting roller being arranged in a bearing plate, said bearing plate being laterally displaceable along a portion of a side member.

5. The apparatus according to claim 4, said bearing plate including a first bearing bore positioned below said side member and a second bearing bore positionable above said side member.

6. The apparatus according to claim 4, said bearing plate including a bore, said bearing plate being mountable such that said bore is positionable in one of above said side member and below said side member.

7. The machine frame according to claim 1, said machine frame being adjustably mounted inclined with respect to the machine room floor.

8. A machine frame for an elevator drive, said machine frame comprising:

a drive pulley;

a deflecting roller;

a bearing plate for rotatably mounting said deflecting roller; and first and second supportable ends, said bearing plate being selectively mountable to provide plurality of mounting positions for the deflecting roller to change a distance between a rotational axis of said drive pulley and a rotational axis of said deflecting roller.

9. The machine frame according to claim 8, said bearing plate being structured and arranged for adjustably varying a distance between a cage cable and a counterweight cable.

10. The machine frame according to claim 8, further comprising a lateral side member, said bearing plate being movably affixable to said lateral side member.

11. The machine frame according to claim 10, said bearing plate being structured and arranged for movably positioning said deflecting roller in a direction parallel to a longitudinal direction of said lateral side member.

12. The machine frame according to claim 10, said bearing plate being structured and arranged for positioning an axle of said deflecting roller at one of above said lateral side member and below said lateral side member.

13. The machine frame according to claim 10, said lateral side member being positionable parallel to a frame floor.

14. The machine frame according to claim 10, said lateral side member being positionable at an angle with respect to a frame floor.

15. The machine frame according to claim 8, further comprising a pedestal for one of adjustably raising and lowering at least one of said first and second supportable ends.

16. The machine frame according to claim 15, said pedestal being structured and arranged for adjustably varying a looping angle.

17. The machine frame according to claim 8, said bearing plate being selectively positionable to provide a plurality of mounting positions for the deflecting roller to change a distance between a cage cable and a counterweight cable.

* * * * *